United States Patent [19]

Roschinski

[11] Patent Number: 5,012,768

[45] Date of Patent: May 7, 1991

[54] COOLING SYSTEM

[75] Inventor: Dieter Roschinski, Cologne, Fed. Rep. of Germany

[73] Assignee: Kloeckner-Humboldt-Deutz AG, Cologne, Fed. Rep. of Germany

[21] Appl. No.: 511,065

[22] Filed: Apr. 19, 1990

[30] Foreign Application Priority Data

4/1989 [DE] Fed. Rep. of Germany ..... 3912734

[51] Int. Cl.[5] ..... F01P 7/10

[52] U.S. Cl. ..... 123/41.49; 123/41.14

[58] Field of Search ..... 123/41.14, 41.49, 41.7; 165/51

[56] References Cited

FOREIGN PATENT DOCUMENTS 60-159824 10/1985 Japan ..... 123/41.49

728347 4/1955 United Kingdom ..... 123/41.49

*Primary Examiner*—Noah P. Kamen

*Attorney, Agent, or Firm*—Charles L. Schwab

[57] ABSTRACT

Known cooling systems exhibit separate radiators (3), compensator reservoirs (2) and fan shrouds (1). These parts must all be mounted separately, then, and as they are generally placed at various locations in the vehicle, connecting hoses must be led from the various mounting places to the internal-combustion engine.

In accordance with the invention, the compensator reservoir (2) and the fan shroud (1) are fabricated in one piece and made as a support for the radiator (3). Thus, only one part need be mounted on the vehicle or on the internal-combustion engine, and only one hose run need be provided to connect the cooling system to the internal-combustion engine.

4 Claims, 1 Drawing Sheet

COOLING SYSTEM

This invention relates to a cooling system for internal combustion engines in accordance with the preamble of claim 1.

PRIOR ART STATEMENT

From automobile making there are known cooling systems for internal-combustion engines, which consist of radiator, fan shroud and compensator reservoir. The aforementioned parts are all fabricated and arranged separately from one another. This means that the parts must be mounted individually, and connection hoses must be led from the internal-combustion engine to the several mounting points. In addition to high production cost, this has the consequence of high costs for maintenance or for replacement of the parts.

OBJECTS AND BRIEF SUMMARY OF THE INVENTION

It is the object of the invention to create a cooling system that avoids the aforementioned disadvantages and can be fabricated at low cost and maintained easily.

In accordance with the invention, this object is achieved by virtue of the fact that the compensator reservoir and the fan shroud are fabricated in one piece and made as a support for the radiator.

Such a support has the advantage that only one part need be mounted on the vehicle or on the internal-combustion engine. The support can be made, for example, of plastic or metal in such a fashion that the heat exchanger forming the radiator is mountable directly on the support without connecting lines. By virtue of the fact that only one package of hoses or one plug-in tube connection need be led from the internal-combustion engine to the support, the assembly and maintenance cost is reduced, since the parts can be preassembled and thus the entire package, for example, is replaceable.

In a preferred embodiment of the cooling system, said system exhibits, at the geodetically lowest point of the support, a hole opening to the environment and closable with a screw plug, which hole is connected to the interior of the compensator reservoir and of the radiator. In a further embodiment of the invention, the hole and the screw plug are made so that, when the screw plug is in a screwed-in position, the interior of the compensator reservoir is closed off from the interior of the radiator and from the environment, and the screw plug, when in a vent position, opens up a connection between the interior of the compensator reservoir and the interior of the radiator and simultaneously closes off both interiors from the environment. By means of this design, coolant changing and the filling process are facilitated. In order to drain the coolant, the screw plug is completely removed from the hole so that the coolant located in the radiator and in the compensator reservoir can be quickly and completely removed. For refilling or topping up of the cooling system with coolant, the screw plug is screwed in or out to a vent position, and quick filling of the system is made possible by the direct connection of the interiors of compensator reservoir and radiator. After the filling of the cooling system, the screw plug is then screwed all the way in and the connection between the radiator and the compensator reservoir, which connection is not necessary or desirable in the normal situation, is closed off.

Further advantages of the invention can be seen in the description of the drawing, in which an exemplary embodiment of the invention, illustrated in the Figures, is described.

DETAILED DESCRIPTION OF THE DRAWINGS

Figure 2:
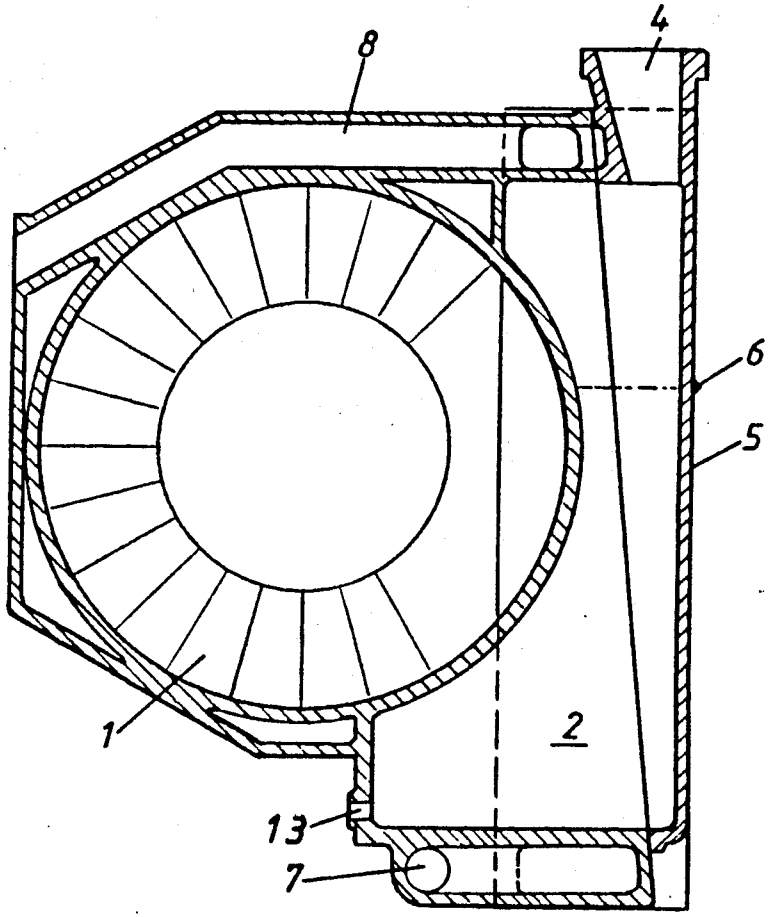
FIG. 2 shows a cross section through FIG. 1.
Figure 1:
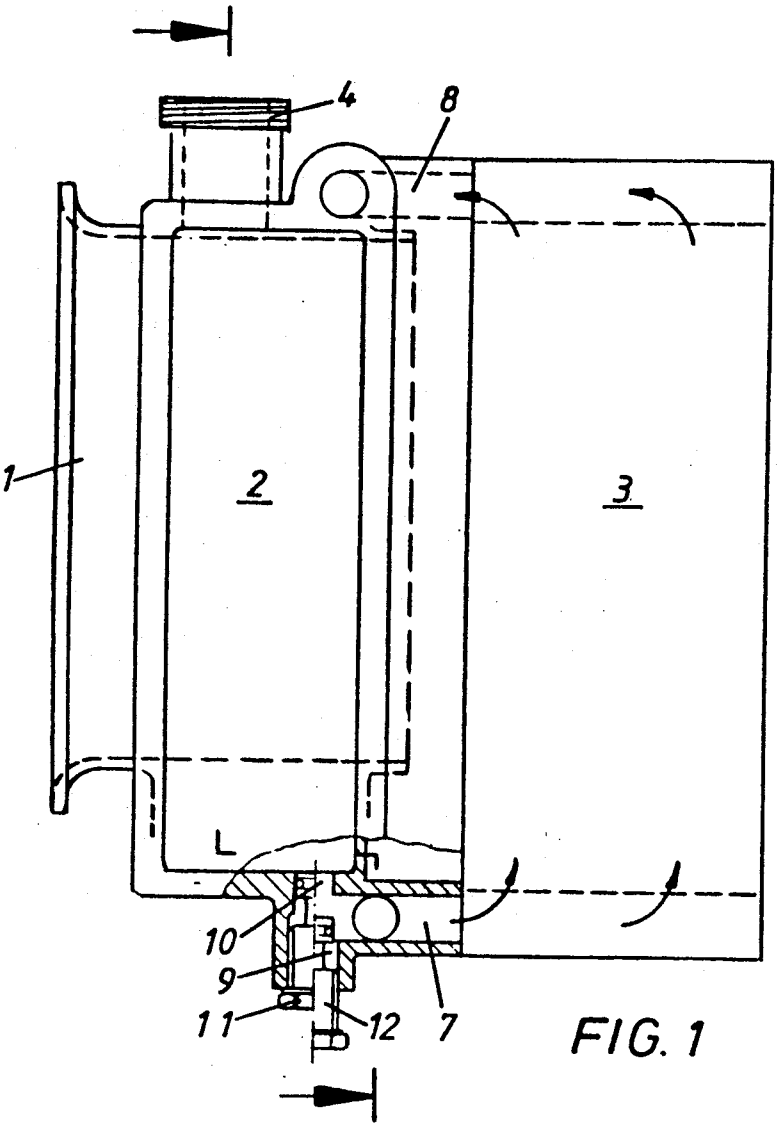
FIG. 1 shows a side view with a detail cross section of the cooling system.

The support in accordance with FIG. 1 includes a fan shroud 1 and a compensator reservoir 2, the support being designed in such a manner that without connecting hoses or the like, a radiator 3 can be mounted on it or on the compensator reservoir 2. A fill pipe 4 opens directly into the compensator reservoir 2. The back wall 5 (FIG. 2) of the compensator reservoir can be made of a transparent material and can exhibit one or a plurality of markings indicating, for example, minimum and maximum coolant levels. The coolant supply line 7 and the coolant drain line 8 to and from the radiator respectively, are led up to the fan shroud 1 so that only short connecting lines to the internal-combustion engine are required. At the geodetically lowest point of the support, below the compensator reservoir 2, there is a hole 9, which extends, via a connection 10, into the interior of the compensator reservoir 2 and, via the coolant supply line 7, into the interior of the radiator 3. The connection 10 to the interior of the compensator reservoir 2 is closed off by the screw plug 11 in its screwed-in position. If the screw plug 11 is brought to the vent position 12, there is a liquid connection from the interior of the radiator 3, via the coolant supply line 7 and the connection 10, to the interior of the compensator reservoir, and the coolant charged via the fill pipe 4 goes directly into the entire cooling system. For normal operation of the internal-combustion engine, the screw 11 is screwed all the way in and the connection 10 is closed off. If the support is mounted directly on the internal-combustion engine, the coolant supply line 7 and coolant drain line 8 can be made so that they can be connected directly to the coolant pump of the internal-combustion engine and a drain from the internal-combustion engine. Also opening into the interior of the compensator reservoir 2 is a connecting pipe 13, which forms a bypass return line to the coolant pump of the internal-combustion engine. Moreover, the cooling system in accordance with the invention is suitable for any kind of coolant, such as, for example, oil or water.

The embodiments of the invention in which an exclusive property or privilege is claimed are defined as follows:

1. Cooling system for internal-combustion engines, exhibiting at least a radiator (3), a fan shroud (1) positioned for directing air through said radiator (3) and a compensator reservoir (2), operable to communicate with said radiator, characterized by the fact that the compensator reservoir (2) and the fan shroud (1) are fabricated in one piece and made as a support for the radiator (3).

2. Cooling system in accordance with claim 1, characterized by the fact that, at the geodetically lowest point of the support, there is arranged a hole (9) opening to the environment and closable with a screw plug (11), which hole is connected to the interior of the compensator reservoir (2) and the interior of the radiator (3).

3. Cooling system in accordance with claim 2, characterized by the fact that the screw plug (11), when in a screwed-in position, closes off the interior of the compensator reservoir (2) from the interior of the radiator (3) and from the environment.

4. Cooling system in accordance with claim 2 or 3, characterized by the fact that the screw plug (11), when in a vent position, opens up a connection between the interior of the compensator reservoir (2) and the interior of the radiator (3) and closes off the interior of the compensator reservoir (2) and the interior of the radiator (3) from the environment.

* * * * *